US006415799B1

(12) United States Patent
Tuzzolino, Jr.

(10) Patent No.: US 6,415,799 B1
(45) Date of Patent: Jul. 9, 2002

(54) SMOKING DETERRING ASHTRAY DEVICE

(76) Inventor: Salvatore Tuzzolino, Jr., 1700 W. Acres Rd., Joliet, IL (US) 60435

( * ) Notice: Subject to any disclaimer, the term of this patent is extended or adjusted under 35 U.S.C. 154(b) by 76 days.

(21) Appl. No.: 09/697,967

(22) Filed: Oct. 26, 2000

(51) Int. Cl.[7] ..... A24F 15/08; A24F 13/08; A24F 13/16

(52) U.S. Cl. ..... 131/240.1; 131/189; 131/238; 131/231; 131/241; 40/407; 446/24; D27/114

(58) Field of Search ..... 131/231, 238, 131/240.1, 241, 175, 189; D27/114; 40/406, 407; 446/24

(56) References Cited

U.S. PATENT DOCUMENTS

| | | | | |
|---|---|---|---|---|
| 1,143,458 A | * | 6/1915 | Stern | 446/24 |
| 1,475,034 A | * | 11/1923 | Slater | 422/291 |
| 1,633,313 A | * | 6/1927 | Carter et al. | 40/407 |
| 2,105,904 A | | 1/1938 | Dale | |
| D160,654 S | | 10/1950 | Pagano | |
| 3,757,801 A | | 9/1973 | Breslow et al. | |
| 4,733,675 A | | 3/1988 | Destro | |
| 4,881,554 A | | 11/1989 | Obasogie | |
| 4,926,573 A | | 5/1990 | Hetrick | |

* cited by examiner

*Primary Examiner*—James Derrington
*Assistant Examiner*—Dionne A. Walls

(57) ABSTRACT

A smoking deterring ashtray device for using as a smoking deterrent to get the user to stop smoking. The smoking deterring ashtray device includes a base member; and also includes a body assembly including a torso-shaped body member being securely disposed upon said base member and having a passageway extending therethrough with the torso-shaped body member further having an upper portion, a lower portion and a front; and further includes an ashtray assembly including a container being securely mounted upon the base member; and also includes a cigarette/cigar support assembly being securely disposed upon the container and being disposed upon the front and at the lower portion of the torso-shaped body member.

9 Claims, 2 Drawing Sheets

SMOKING DETERRING ASHTRAY DEVICE

BACKGROUND OF THE INVENTION

1. Field of the Invention

The present invention relates to a smoking terminating device and more particularly pertains to a new smoking deterring ashtray device for using as a smoking deterrent to get the user to stop smoking.

2. Description of the Prior Art

The use of a smoking terminating device is known in the prior art. More specifically, a smoking terminating device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,757,801; U.S. Pat. No. 4,733,675; U.S. Pat. No. 2,105,904; U.S. Pat. No. 4,926,573; U.S. Pat. No. 4,881,554; and U.S. Pat. No. Des. 160,654.

While these devices fulfill their respective, particular objectives and requirements, the aforementioned patents do not disclose a new smoking deterring ashtray device. The inventive device includes a base member; and also includes a body assembly including a torso-shaped body member being securely disposed upon said base member and having a passageway extending therethrough with the torso-shaped body member further having an upper portion, a lower portion and a front; and further includes an ashtray assembly including a container being securely mounted upon the base member; and also includes a cigarette/cigar support assembly being securely disposed upon the container and being disposed upon the front and at the lower portion of the torso-shaped body member.

In these respects, the smoking deterring ashtray device according to the present invention substantially departs from the conventional concepts and designs of the prior art, and in so doing provides an apparatus primarily developed for the purpose of using as a smoking deterrent to get the user to stop smoking.

SUMMARY OF THE INVENTION

In view of the foregoing disadvantages inherent in the known types of smoking terminating device now present in the prior art, the present invention provides a new smoking deterring ashtray device construction wherein the same can be utilized for using as a smoking deterrent to get the user to stop smoking.

The general purpose of the present invention, which will be described subsequently in greater detail, is to provide a new smoking deterring ashtray device which has many of the advantages of the smoking terminating device mentioned heretofore and many novel features that result in a new smoking deterring ashtray device which is not anticipated, rendered obvious, suggested, or even implied by any of the prior art smoking terminating device, either alone or in any combination thereof.

To attain this, the present invention generally comprises a base member; and also includes a body assembly including a torso-shaped body member being securely disposed upon said base member and having a passageway extending therethrough with the torso-shaped body member further having an upper portion, a lower portion and a front; and further includes an ashtray assembly including a container being securely mounted upon the base member; and also includes a cigarette/cigar support assembly being securely disposed upon the container and being disposed upon the front and at the lower portion of the torso-shaped body member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new smoking deterring ashtray device which has many of the advantages of the smoking terminating device mentioned heretofore and many novel features that result in a new smoking deterring ashtray device which is not anticipated, rendered obvious, suggested, or even implied by any of the prior art smoking terminating device, either alone or in any combination thereof.

It is another object of the present invention to provide a new smoking deterring ashtray device which may be easily and efficiently manufactured and marketed.

It is a further object of the present invention to provide a new smoking deterring ashtray device which is of a durable and reliable construction.

An even further object of the present invention is to provide a new smoking deterring ashtray device which is susceptible of a low cost of manufacture with regard to both materials and labor, and which accordingly is then susceptible of low prices of sale to the consuming public, thereby making such smoking deterring ashtray device economically available to the buying public.

Still yet another object of the present invention is to provide a new smoking deterring ashtray device which provides in the apparatuses and methods of the prior art some of the advantages thereof, while simultaneously overcoming some of the disadvantages normally associated therewith.

Still another object of the present invention is to provide a new smoking deterring ashtray device for using as a smoking deterrent to get the user to stop smoking.

Yet another object of the present invention is to provide a new smoking deterring ashtray device which includes a base member; and also includes a body assembly including a torso-shaped body member being securely disposed upon said base member and having a passageway extending therethrough with the torso-shaped body member further having an upper portion, a lower portion and a front; and further includes an ashtray assembly including a container being securely mounted upon the base member; and also includes a cigarette/cigar support assembly being securely disposed upon the container and being disposed upon the front and at the lower portion of the torso-shaped body member.

Still yet another object of the present invention is to provide a new smoking deterring ashtray device that would allow the user to see how smoke builds up in the tubular members to effectively deter smokers to quit smoking.

Even still another object of the present invention is to provide a new smoking deterring ashtray device that serves as a convenient and effective way to get smokers to quit their habit of smoking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
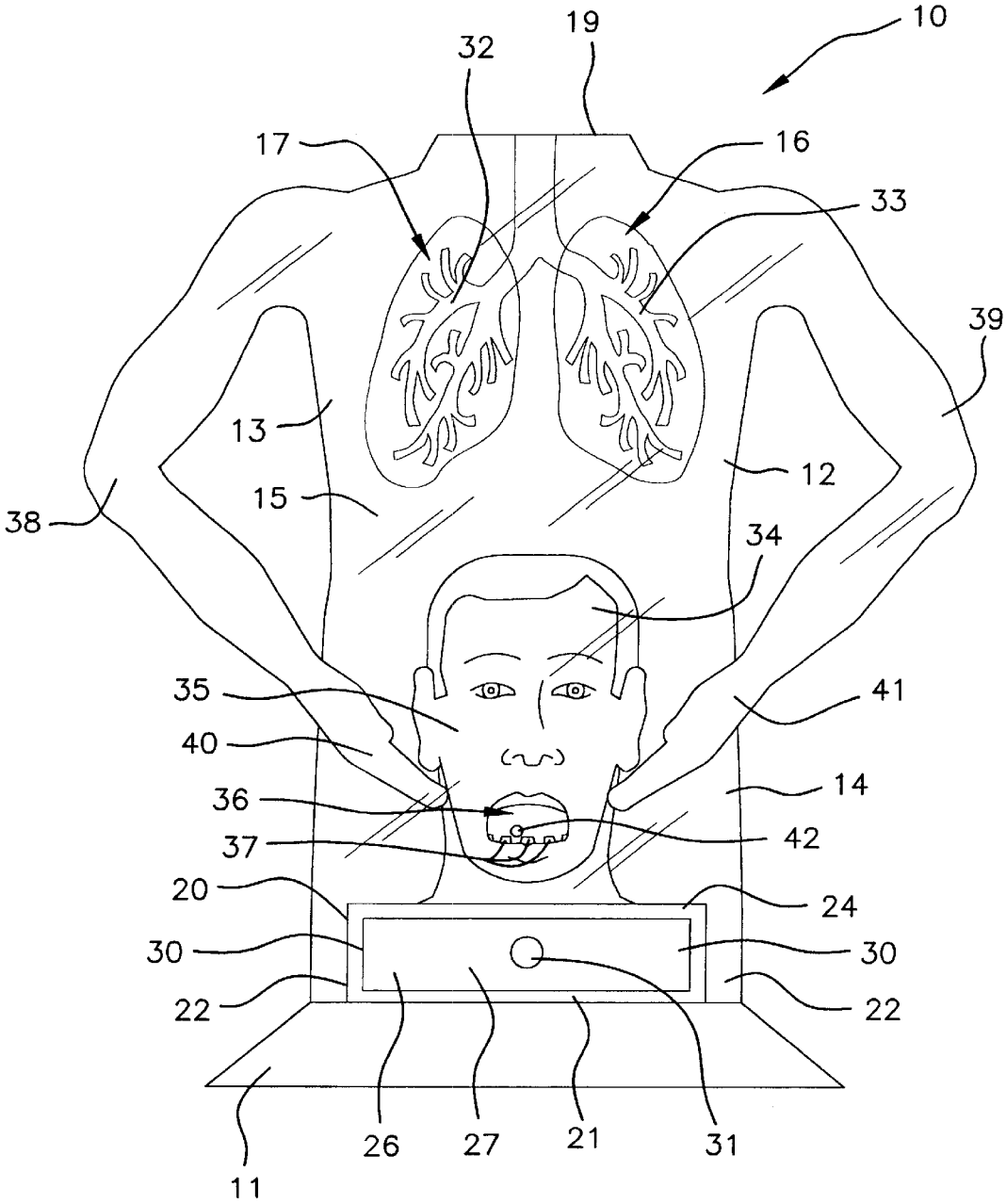
FIG. 1 is a front elevational view of a new smoking deterring ashtray device according to the present invention.
Figure 2:
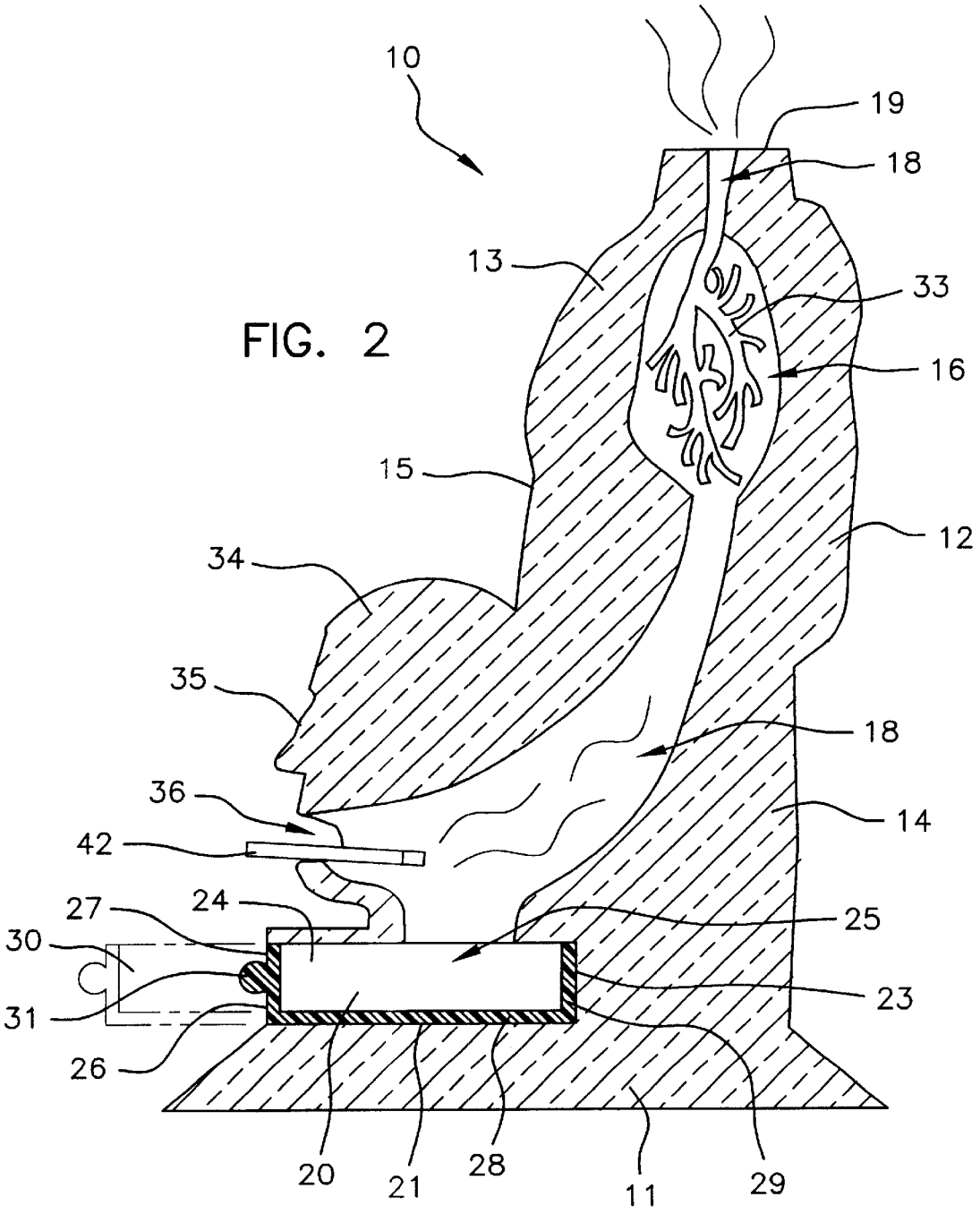
FIG. 2 is a side cross-sectional view of the present invention.

With reference now to the drawings, and in particular to FIGS. 1 through 2 thereof, a new smoking deterring ashtray device embodying the principles and concepts of the present invention and generally designated by the reference numeral 10 will be described.

As best illustrated in FIGS. 1 through 2, the smoking deterring ashtray device 10 generally comprises a base member 11, and also comprises a body assembly including a torso-shaped body member 12 being securely and conventionally disposed upon the base member 11 and having a passageway 18 extending therethrough. The torso-shaped body member 12 further has an upper portion 13, a lower portion 14 and a front 15. The torso-shaped body member 12 also includes cavities 16,17 conventionally disposed in the upper portion 13 thereof, and further includes tubular members 32,33 being shaped like that of human lungs and being conventionally disposed in the cavities 16,17 and being conventionally connected to the passageway 18. The body assembly further includes arm members 38,39 being securely and conventionally attached to sides of the torso-shaped body member 12 at the upper portion 13 thereof, and also includes hand-shaped members 40,41 being securely and conventionally attached to ends of the arm members 38,39. The passageway 18 extends out through a top end 19 of the torso-shaped body member 12 and out through the front 15 at the lower portion 14 of the torso-shaped body member 12. The torso-shaped body member 12 and the tubular members 32,33 are made of clear plastic to allow a user to see how smoke builds up in the tubular members 32,33.

An ashtray assembly includes a container 20 being securely and conventionally mounted upon the base member 11. The container 20 includes an open front, side walls 22, a bottom wall 21, a back wall 23, a top wall 24, and an opening 25 being disposed through the top wall 24 and into the container 20. The opening 25 is conventionally connected to the passageway 18. The ashtray assembly further includes a tray 26 having a bottom wall 28, a front wall 27, side walls 30, a back wall 29, and an open top. The tray 26 also has a knob-shaped handle member 31 being securely and conventionally attached to an exterior of the front wall 27 thereof. The tray 26 is adapted to be removably disposed in the container 20 through the open front of the container 20 to essentially receive ashes from cigarettes 42 and cigars.

A cigarette/cigar support assembly is securely and conventionally disposed upon the container 20 and is conventionally disposed upon the front 15 and at the lower portion of 14 the torso-shaped body member 11. The cigarette/cigar support assembly includes a head-shaped member 34 having a front 35 and a mouth-shaped opening 36 being disposed through the front 35 thereof and being conventionally connected to the passageway 18. The cigarette/cigar support assembly also includes cigarette/cigar support members 37 being spaced apart and being conventionally disposed in the opening 36 of the head-shaped member 34 and being adapted to hold a cigarette 42 or cigar therebetween with the cigarette/cigar support members 37 being shaped like that of teeth of a human being. The hand-shaped members 40,41 are connected to sides of the head-shaped member 34 and are holding the head-shaped member 34.

In use, when smoking, the user would place the cigarette 42 between the cigarette/cigar support members 37 with the smoke passing through the passageway 18 into the tubular members 32,33 and out through the top end 19 of the torso-shaped body member 11 with the ashes from the cigarette 42 being deposited into the tray 26 which can be emptied as desired by the user. The user will be able to see the buildup of tar and nicotine in the tubular members 32,33 which, hopefully, will get the user to quit smoking.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A smoking deterring ashtray device comprising:

a base member;

a body assembly including a torso-shaped body member being securely disposed upon said base member and having a passageway extending therethrough, said torso-shaped body member further having a an upper portion, a lower portion and a front;

an ashtray assembly including a container being securely mounted upon said base member; and a cigarette/cigar support assembly being securely disposed upon said container and being disposed upon said front and at said lower portion of said torso-shaped body member.

2. A smoking deterring ashtray device as described in claim 1, wherein said torso-shaped body member also includes cavities disposed in said upper portion thereof, and further includes tubular members being shaped like that of human lungs and being disposed in said cavities and being connected to said passageway.

3. A smoking deterring ashtray device as described in claim 2, wherein said body assembly further includes arm members being securely attached to sides of said torso-shaped body member at said upper portion thereof, and also includes hand-shaped members being securely attached to ends of said arm members.

4. A smoking deterring ashtray device as described in claim 3, wherein said passageway extends out through a top end of said torso-shaped body member and out through said front at said lower portion of said torso-shaped body member.

5. A smoking deterring ashtray device as described in claim 4, wherein said container includes an open front, side walls, a bottom wall, a back wall, a top wall, and an opening being disposed through said top wall and into said container, said opening being connected to said passageway.

6. A smoking deterring ashtray device as described in claim 5, wherein said ashtray assembly further includes a tray having a bottom wall, a front wall, side walls, a back wall, and an open top, said tray also having a knob-shaped handle member being securely attached to an exterior of said front wall thereof, said tray being adapted to be removably disposed in said container through said open front of said container to essentially receive ashes from cigarettes and cigars.

7. A smoking deterring ashtray device as described in claim 6, wherein said cigarette/cigar support assembly includes a head-shaped member having a front and a mouth-shaped opening being disposed through said front thereof and being connected to said passageway, said cigarette/cigar support assembly also including cigarette/cigar support members being spaced apart and being disposed in said opening of said head-shaped member and being adapted to hold a cigarette or cigar therebetween, said cigarette/cigar support members being shaped like that of teeth of a human being.

8. A smoking deterring ashtray device as described in claim 7, wherein said torso-shaped body member and said tubular members are made of clear plastic to allow a user to see how smoke builds up in said tubular members.

9. A smoking deterring ashtray device comprising:

a base member;

a body assembly including a torso-shaped body member being securely disposed upon said base member and having a passageway extending therethrough, said torso-shaped body member further having a an upper portion, a lower portion and a front, said torso-shaped body member also including cavities disposed in said upper portion thereof, and further including tubular members being shaped like that of human lungs and being disposed in said cavities and being connected to said passageway, said body assembly further including arm members being securely attached to sides of said torso-shaped body member at said upper portion thereof, and also including hand-shaped members being securely attached to ends of said arm members, said passageway extending out through a top end of said torso-shaped body member and out through said front at said lower portion of said torso-shaped body member, said torso-shaped body member and said tubular members being made of clear plastic to allow a user to see how smoke builds up in said tubular members;

an ashtray assembly including a container being securely mounted upon said base member, said container including an open front, side walls, a bottom wall, a back wall, a top wall, and an opening being disposed through said top wall and into said container, said opening being connected to said passageway, said ashtray assembly further including a tray having a bottom wall, a front wall, side walls, a back wall, and an open top, said tray also having a knob-shaped handle member being securely attached to an exterior of said front wall thereof, said tray being adapted to be removably disposed in said container through said open front of said container to essentially receive ashes from cigarettes and cigars; and a cigarette/cigar support assembly being securely disposed upon said container and being disposed upon said front and at said lower portion of said torso-shaped body member, said cigarette/cigar support assembly including a head-shaped member having a front and a mouth-shaped opening being disposed through said front thereof and being connected to said passageway, said cigarette/cigar support assembly also including cigarette/cigar support members being spaced apart and being disposed in said opening of said head-shaped member and being adapted to hold a cigarette or cigar therebetween, said cigarette/cigar support members being shaped like that of teeth of a human being, said hand-shaped members being connected to sides of said head-shaped member and holding said head-shaped member.

* * * * *